US008169150B2

(12) United States Patent
Peker et al.

(10) Patent No.: US 8,169,150 B2
(45) Date of Patent: May 1, 2012

(54) POWERING AND CONTROLLING LIGHT EMITTING DIODES VIA THERMALLY SEPARATED ARRAYS OF DISSIPATIVE ACTIVE ELEMENTS

(75) Inventors: Arkadiy Peker, New Hyde Park, NY (US); Alon Ferentz, Bat Yam (IL); Dror Korcharz, Bat Yam (IL); Nadav Barnea, Neve Savion (IL); Migel Jacubovski, Hod Hasharon (IL); Itay Cohen, Kfar Sava (IL); Gustavo Aizenberg, Ness Ziona (IL)

(73) Assignee: Microsemi Corp.—Analog Mixed Signal Group Ltd., Hod Hasharon (IL)

( * ) Notice: Subject to any disclaimer, the term of this patent is extended or adjusted under 35 U.S.C. 154(b) by 439 days.

(21) Appl. No.: 12/541,952

(22) Filed: Aug. 16, 2009

(65) Prior Publication Data

US 2010/0045194 A1 Feb. 25, 2010

Related U.S. Application Data

(60) Provisional application No. 61/090,080, filed on Aug. 19, 2008.

(51) Int. Cl.
*H05B 41/16* (2006.01)
*G09G 3/32* (2006.01)

(52) U.S. Cl. ..... 315/246; 315/291; 315/297; 315/299; 345/82

(58) Field of Classification Search ..... 315/246, 315/291, 299, 307, 308, 185 R, 295, 297, 315/193; 345/82, 211, 212, 102
See application file for complete search history.

(56) References Cited

U.S. PATENT DOCUMENTS

| | | | | |
|---|---|---|---|---|
| 4,706,010 | A | 11/1987 | Callen et al. | |
| 5,682,303 | A | 10/1997 | Goad | |
| 6,949,916 | B2 | 9/2005 | Chapuis | |
| 7,000,125 | B2 | 2/2006 | Chapuis et al. | |
| 7,266,709 | B2 | 9/2007 | Chapuis et al. | |
| 7,605,550 | B2 * | 10/2009 | Ferentz et al. | 315/312 |
| 7,791,584 | B2 * | 9/2010 | Korcharz et al. | 345/101 |
| 7,928,856 | B2 * | 4/2011 | Jacubovski et al. | 340/653 |
| 7,969,430 | B2 * | 6/2011 | Korcharz et al. | 345/211 |
| 2007/0195024 | A1 * | 8/2007 | Korcharz et al. | 345/82 |
| 2010/0259182 | A1 * | 10/2010 | Man et al. | 315/250 |

* cited by examiner

*Primary Examiner* — Vibol Tan
(74) *Attorney, Agent, or Firm* — Simon Kahn

(57) ABSTRACT

A chipset for powering and controlling a plurality of light emitting diode (LED) strings. The chipset includes a controller having a pulse width modulating (PWM) functionality and a data transfer interface circuitry; and at least one dissipative active element array comprising a plurality of dissipative active elements. The dissipative active element array(s) are packaged to be thermally separate from the controller. The PWM functionality is arranged to individually pulse width modulate a current flow through each of the LED strings. Each of the plurality of dissipative active elements is associated with a particular one of the plurality of LED strings and is arranged to limit the current flow of the pulse width modulated current that flows through the particular LED string to a value, the value being responsive to a value output by the controller via the data transfer interface circuitry.

19 Claims, 7 Drawing Sheets

POWERING AND CONTROLLING LIGHT EMITTING DIODES VIA THERMALLY SEPARATED ARRAYS OF DISSIPATIVE ACTIVE ELEMENTS

CROSS-REFERENCE TO RELATED APPLICATION

This application claims priority to U.S. Provisional Patent Application Ser. No. 61/090,080 filed Aug. 19, 2008, entitled "Powering and Controlling Light Emitting Diodes Via Thermally Separated Arrays of Dissipative Active Elements", the entire contents of which are incorporated herein by reference.

TECHNICAL FIELD

The present invention relates to the field of light emitting diode based lighting systems and more particularly to a system for powering a plurality of LED strings and controlling current there through via thermally separated arrays of dissipative active elements.

BACKGROUND

Light emitting diodes (LEDs) and in particular high intensity and medium intensity LED strings are rapidly coming into wide use for lighting applications. LEDs with an overall high luminance are useful in a number of lighting applications including, but not limited to, backlighting for liquid crystal display (LCD) based monitors and televisions, collectively hereinafter referred to as a monitor. In a large LCD monitor the LEDs are typically supplied in one or more strings of serially connected LEDs, thus sharing a common current. Similarly, in general lighting applications, the LEDs are typically supplied as one or more strings of serially connected LEDs sharing a common current.

In order supply a white light, for a backlight of a monitor or for general lighting, one of two basic techniques are commonly used. In a first technique one or more strings of "white" LEDs are utilized, the white LEDs typically comprising a blue LED with a phosphor which absorbs the blue light emitted by the LED and emits a white light. In a second technique one or more individual strings of colored LEDs are placed in proximity so that in combination their light is seen as a white light. Often, two strings of green LEDs are utilized to balance one string each of red and blue LEDs. In the case of colored LEDs, a further mixer is required, which may be part of the diffuser, to ensure that the light of the colored LEDs are not viewed separately, but are rather mixed to give a white light. The white point of the light is an important factor to control, and much effort in design and manufacturing is centered on the need for a controlled white point.

In certain applications, each of the colored LED strings is typically controlled by both amplitude modulation (AM) and pulse width modulation (PWM) to achieve an overall fixed perceived luminance and color balance. AM is typically used to set the white point produced by the disparate colored LED strings by setting the constant current flow through the LED strings to a value determined as part of a white point calibration process and PWM is typically used to variably control the overall luminance, or brightness, of the monitor without affecting the white point balance. Thus the current, when pulsed on, is held constant to maintain the white point produced by the combination of disparate colored LED strings, and the PWM duty cycle is controlled to dim or brighten the overall luminance by adjusting the average current over time.

The PWM duty cycle of each color is further modified to maintain the white point, preferably responsive to a color sensor. It is to be noted that different colored LEDs age, or reduce their luminance as a function of current, at different rates and thus the PWM duty cycle of each color must be modified over time to maintain the white point.

Each of the disparate colored LED strings has a voltage requirement associated with the forward voltage drop of the LEDs and the number of LEDs in the LED string. In the event that multiple LED strings of any particular color are used, the voltage drop across strings of the same color having the same number of LEDs per string may also vary due to manufacturing tolerances and temperature differences. Ideally, separate power sources are supplied for each LED string, the power sources being adapted to adjust their voltage output to be in line with the voltage drop across the associated LED string. Such a large plurality of power sources effectively minimizes excess power dissipation however the requirement for a large plurality of power sources is costly.

An alternative solution, which reduces the number of power sources required, is to supply a single power source for each color. Thus a plurality of LED strings of a single color is driven by a single power source, and the number of power sources required is reduced to the number of different colors, i.e. in the case of colored LEDs typically to 3. Unfortunately, since as indicated above different LED strings of the same color may exhibit different voltage drops, such a solution further requires an active element in series with each LED string, also known as a dissipative element, to compensate for the different voltage drops so as to ensure an essentially equal current through each of the LED strings of the same color.

FIG. 1A illustrates a high level block diagram of a system for powering and controlling a plurality of LED strings using a single controllable power source according to the prior art. The system includes a controllable power source 11 responsive to a controller 10 implemented as an integrated circuit, a plurality of load resistors RA, RB, RC and RD and a plurality of LED strings 31A, 32A, 33A and 34A. Controller 10 comprises dissipative active elements 20A, 20B, 20C and 20D integrated within the architecture of controller 10. An output of controllable power source 11 is connected in parallel to a first end of each of LED strings 31A, 32A, 33A and 34A, and a second end of each of LED strings 31A, 32A, 33A and 34A is connected to a first contact of a respective one of dissipative active elements 20A, 20B, 20C and 20D. A second contact of each of dissipative active elements 20A, 20B, 20C and 20D is connected to a common potential, such as a ground potential, via a respective one of sense resistors RA, RB, RC and RD.

In operation, power is driven through each LED string 31A, 32A, 33A and 34A by controllable power source 11, with the output voltage level of controllable power source 11 being responsive to an output of controller 10. Controller 10 is further operative to control dissipative active elements 20A, 20B, 20C and 20D so as to ensure that the same level of current is driven through each of LED strings 31A, 32A, 33A and 34A. In particular, the resistance of each of dissipative active elements 20A, 20B, 20C and 20D is controlled, so that the resultant voltage drop across each of sense resistors RA, RB, RC and RD is nearly identical. Furthermore, the voltage drop across each of sense resistors RA, RB, RC and RD is monitored by controller 10 so as to ensure a balanced current, and to determine an appropriate voltage output for controllable power source 11. Dissipative active elements 20A, 20B, 20C and 20D generate heat while dissipating power, negatively impacting the overall die temperature of controller 10. In order to minimize cost, a small die size is preferred for controller 10, and thus there is a severe limitation on the amount of power which may be dissipated by dissipative active elements 20A, 20B, 20C and 20D due to their being packaged within controller 10.

FIG. 1B illustrates a high level block diagram of an alternative arrangement for powering and controlling a plurality of LED strings using a single controllable power source according to the prior art, in which the dissipative elements are not contained within the controller. The system includes a controllable power source 11 responsive to a controller 50 implemented as an integrated circuit, dissipative active elements 40A, 40B, 40C and 40D, a plurality of sense resistors RA, RB, RC and RD and a plurality of LED strings 31A, 32A, 33A and 34A. An output of controllable power source 11 is connected in parallel to a first end of each of LED strings 31A, 32A, 33A and 34A, and a second end of each of LED strings 31A, 32A, 33A and 34A is connected to a first contact of a respective one of dissipative active elements 40A, 40B, 40C and 40D. A second contact of each of dissipative active elements 40A, 40B, 40C and 40D is connected to a common potential, such as a ground potential, via a respective one of sense resistors RA, RB, RC and RD. A control input of each of dissipative active elements 40A, 40B, 40C and 40D is connected to a respective output of controller 50.

In operation, the arrangement of FIG. 1B operates in all respects similarly to the arrangement of FIG. 1A, however placing dissipative active elements 40A, 40B, 40C and 40D external of controller 50 resolves the problem of overheating controller 10. However, the need for control and measurement of the dissipative active elements 40A, 40B, 40C and 40D, and the need to read the voltage drop across each of the external sense resistors RA, RB, RC and RD adds to the total pin count for controller 50, increasing cost.

In summary, neither the arrangement of FIG. 1A, nor the arrangement of FIG. 1B provides an optimum solution taking into account the need for a low footprint, thermal requirements and the need to control the number of pins for a controller.

SUMMARY

Accordingly, in accordance with certain embodiments of the present invention, a group of integrated circuits (a chipset) arranged to power and control a plurality of LED strings is provided. The chipset includes a controller in communication with thermally separated arrays of dissipative active elements, preferably constituted of field effect transistors (FETs) and more preferably constituted of metal oxide semiconductor FETs (MOSFETs). The controller comprises a PWM functionality and a data transfer interface, and the dissipative active elements of the arrays are each preferably arranged as a current limiter limiting current flow there through to a value, the value being responsive to a value output by the controller via the data transfer interface circuitry.

Each of the plurality of dissipative active elements is associated with a particular one of the plurality of LED strings. The PWM functionality is arranged to individually pulse width modulate a current flow through each of the LED strings via the data transfer interface circuitry.

In some embodiments, the dissipative active element arrays each further comprise a voltage sampler and the controller further comprises a voltage sensing module. The voltage sensing module is arranged to receive the output of the voltage sampler from each of the dissipative active element arrays via the data transfer interface, and identify responsive thereto the LED string exhibiting the largest voltage drop. The controller is then operative to control the voltage level output of the power source responsive to the identified sampled voltage associated with the LED string exhibiting the largest voltage drop.

In some embodiments, the dissipative active element array further comprises an over temperature protection module for each one of the dissipative active elements within the array. The over temperature protection module is operative to disable current flow through the respective dissipative active element exhibiting an over temperature condition. There is also provided circuitry within the dissipative active element array for outputting an indication of over temperature to the controller.

Additional features and advantages of the invention will become apparent from the following drawings and description.

BRIEF DESCRIPTION OF THE DRAWINGS

For a better understanding of the invention and to show how the same may be carried into effect, reference will now be made, purely by way of example, to the accompanying drawings in which like numerals designate corresponding sections or elements throughout.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings.

DETAILED DESCRIPTION OF CERTAIN EMBODIMENTS

Figure 1A:
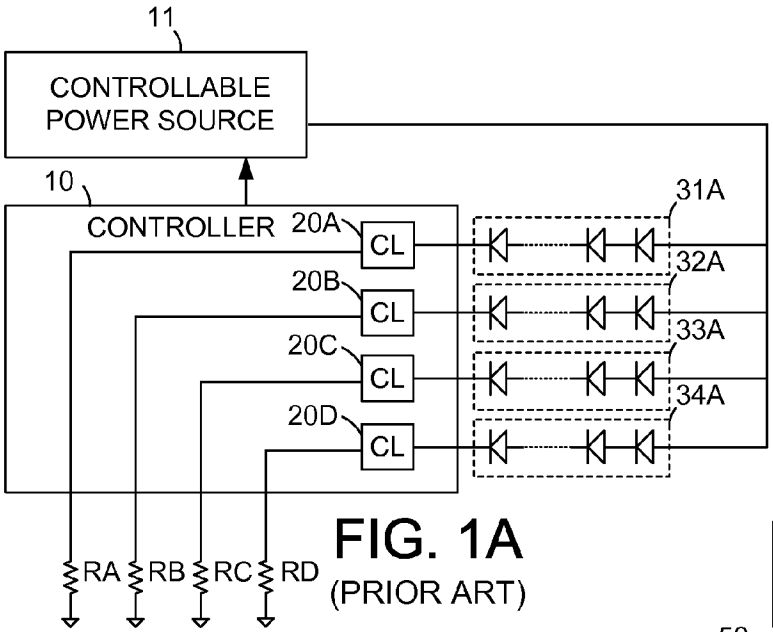
FIG. 1A (PRIOR ART)
FIG. 1A illustrates a high level block diagram of a system for powering and controlling a plurality of LED strings using a single controllable power source according to the prior art.
Figure 1B:
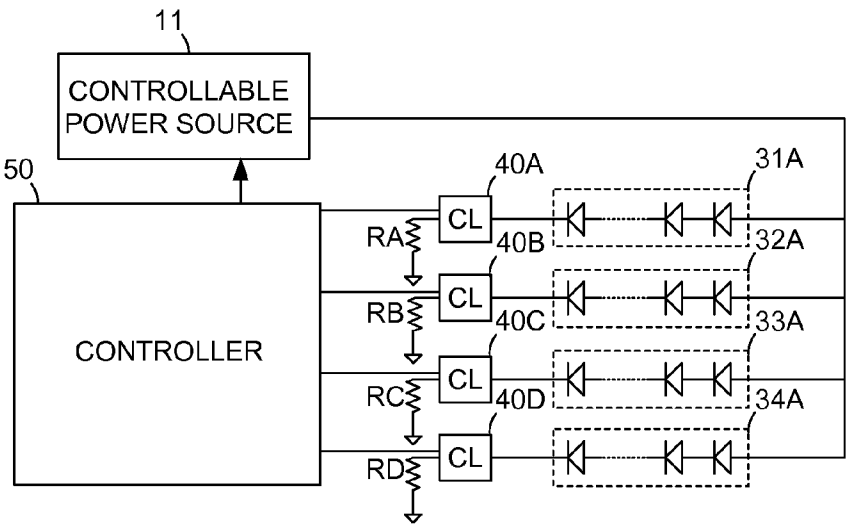
FIG. 1B (PRIOR ART)
FIG. 1B illustrates a high level block diagram of an alternative arrangement for powering and controlling a plurality of LED strings using a single controllable power source according to the prior art, in which the dissipative elements are not contained within the controller.

Before explaining at least one embodiment in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting. In other instances, well-known methods, procedures, components and circuits have not been described in detail so as not to obscure the teachings of the present disclosure.

Figure 2:
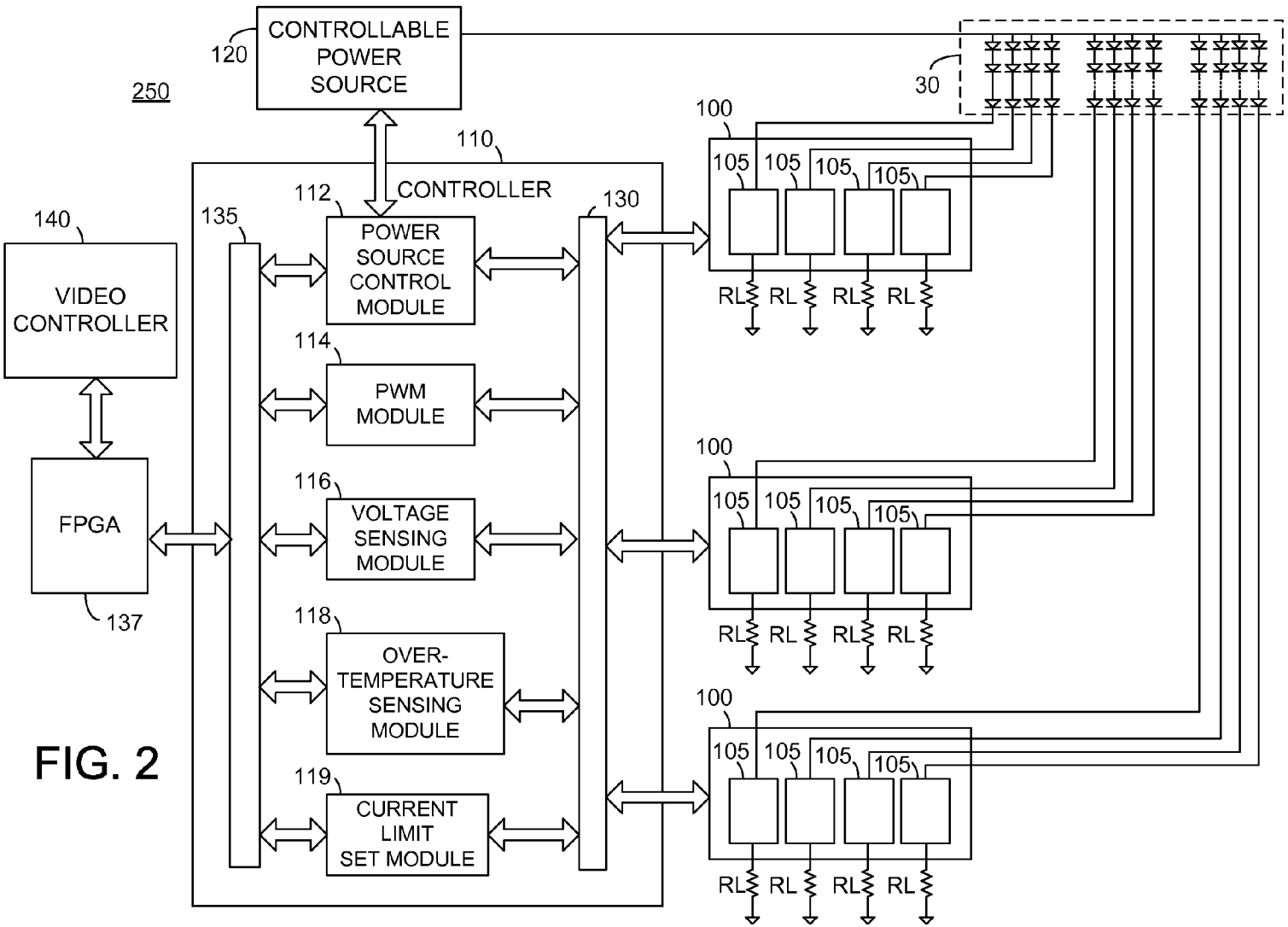
FIG. 2 is a high level schematic block diagram of a system for powering and controlling a plurality of LED strings via thermally separated dissipative active element arrays according to some exemplary embodiments.

FIG. 2 is a high level schematic block diagram of a system for powering and controlling a plurality of LED strings via thermally separated dissipative active element arrays shown as a group of integrated circuits (hereinafter: "a chipset") 250 arranged in cooperation to power and control a plurality of light emitting diode (LED) strings 30 using a single controllable power source 120. The chipset includes a controller 110 exhibiting a power source control module 112, a pulse width modulation (PWM) module 114, a current limit set module 119, a data transfer interface 130 and a control bus 135. In some embodiments, power source control module 112 is coupled to pulse width modulation (PWM) module 114 via data transfer interface 130 or via control bus 135.

In some embodiments, controller 110 further includes a voltage sensing module 116 coupled to data transfer interface 130 and to control bus 135. In some embodiments, controller 110 further includes an over-temperature sensing module 118 coupled to data transfer interface 130 and to control bus 135. Controllable power source 120 is connected to power source control module 112 and a video controller 140 is connected via an FPGA 137, or similar logic block, to control bus 135.

Chipset 250 further includes a plurality of dissipative active element arrays 100, each packaged as a standalone integrated circuit such that it is thermally separated from controller 110. Each dissipative active element array 100 comprises a plurality of dissipative active elements 105, and is in communication with controller 110, and in particular with data transfer interface 130. Associated with each dissipative active element 105 is a particular sense resistor RL.

Each LED string 30 has a first end connected to the output of controllable power source 120 and a second end connected to a first connection of a particular dissipative active element 105. The second connection of each dissipative active element 105 is connected to a first end of the associated sense resistor RL, and the second end of each sense resistor RL is connected to a common potential point, in one embodiment the common potential point being a ground potential. Thus, each LED string 30 is connected in series to a particular dissipative active element 105 and each of the dissipative active elements 105 is responsive to controller 110 via data transfer interface 130.

In operation PWM module 114 is arranged to generate a pulse width modulated signal responsive to an output of video controller 140 via FPGA 137. In some embodiments PWM module 114 is arranged to employ leading edge modulation in which the start time of the pulse is shifted in order to change the duty cycle of the signal. Power source control module 112 is arranged to control the voltage output of controllable power source 120 responsive to an output of voltage sensing module 116, so as to provide sufficient voltage to drive each of the LED strings 30 with a sufficient voltage, preferably while ensuring minimum power dissipation. In one embodiment, power source control module 112 outputs a pulse density modulation signal for control of the voltage output of controllable power source 120. The output of PWM module 114 is transferred via data transfer interface 130 to each dissipative active element array 100 so that a pulse width modulated current is driven through each LED string 30 in accordance with the needs of video controller 140. The pulse width modulated current flows though each LED string 30, associated dissipative active element 105 and associated sense resistor RL to the common potential point for return to controllable power source 120. The value of the current through each of the LED strings 30 is controlled by associated dissipative active element 105, responsive to current limit set module 119, to be equal.

Each dissipative active element 105 controls current responsive to an output of controller 110, particularly current limit set module 119. Specifically, each dissipative active element 105 is arranged to exhibit a resistance in accordance with the voltage drop across the associated LED string 30 connected in series thereto in order to compensate for the different voltage drops across the plurality of LED strings 30 such that an essentially equal current through each of the LED strings 30 is ensured. In certain embodiments each dissipative active element 105 ensures a maximum current responsive to current limit set module 119, and the voltage of controllable power source 120 is adjusted responsive to the LED string 30 exhibiting the greatest voltage drop, equivalent to the lowest current of the LED strings 30. In certain embodiments each dissipative active element 105 ensures a current flow responsive to current limit set module 119, and the voltage of controllable power source 120 is adjusted responsive to the LED string 30 exhibiting the greatest voltage drop, as evidenced by the lowest voltage at the respective nexus of the LED string 30 and the associated dissipative active element 105 so as to minimize total power dissipation by the dissipative active elements 105.

In some embodiments, dissipative active element arrays 100 are arranged to sample the voltage at the second end of each of the LED strings 30 connected thereto and deliver the sampled voltages to controller 110 in the form of a time multiplexed analog signal exhibiting a sequence of voltage levels, wherein each level is associated with a different LED string 30. The analog signal is fed into data transfer interface 130 which in turn is arranged to convert the analog signal exhibiting a sequence of analog voltage levels into a digital representation and further to relate each voltage level to a particular dissipative active element. Voltage sensing module 116 is arranged to receive the digital representation of the voltage levels, each voltage level being related to a particular LED string 30, and associated dissipative active element 105, and determine the LED string 30 exhibiting the largest voltage drop. Power source control module 112 is operative to control the voltage output of controllable power source 120 so as to ensure a sufficient voltage level to drive the determined LED string 30 exhibiting the largest voltage drop. In one particular embodiment, output voltage of controllable power source 120 is set such that associated dissipative active element 105 exhibits minimal resistance and the value of the current flow through the associated sense resistor RL is the target value, to be described further below.

The above has been described in an embodiment in which controllable power source 120 is set responsive to the LED string 30 exhibiting the largest voltage drop, however this is not meant to be limiting in any way. In another embodiment, controllable power source 120 is set to a value responsive to a function of an electrical characteristic of at least one of the LED strings 30. Preferably controllable power source 120 is set to one of the lowest voltage drop, the mean voltage drop and the substantially average voltage drop from among the plurality of LED strings 30, in a manner described further in U.S. Patent Application Publication S/N 2007/0195025 A1, published Aug. 23, 2007 to Korcharz et al, entitled "Voltage Controlled Backlight Driver", the entire contents of which is incorporated herein by reference.

In some embodiments, each dissipative active element array 100 is arranged to sample the temperature of each of the dissipative active elements 105 therein, and in the event of an over temperature condition, to disable current flow through the associated LED string 30 thereby reducing thermal stress on the dissipative active element 105 exhibiting the over temperature condition. Specifically, dissipative active element array 100 is arranged to disable current flow through the associated LED string 30 and dissipative active element 105 upon sensing a temperature beyond a predefined value, and to enable current flow through the associated LED string 30 and dissipative active element 105 when the temperature reaches normal value.

Figure 3A:
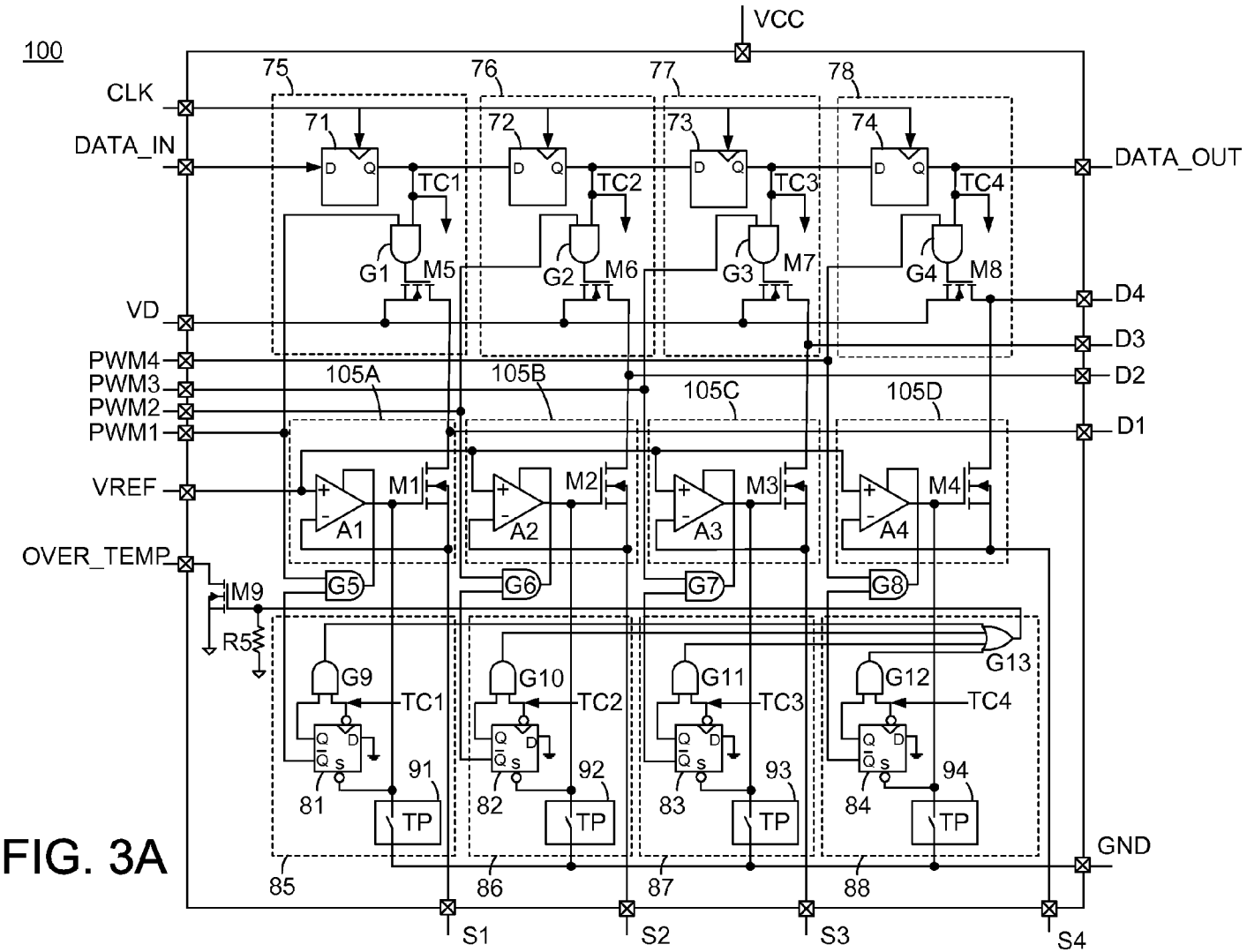
FIG. 3A is a circuit diagram of a dissipative active element array according to some exemplary embodiments.

FIG. 3A is a circuit diagram of a dissipative active element array 100 according to some exemplary embodiments. Dissipative active element array 100 is packaged as an integrated circuit, preferably as a multi chip module, exhibiting: source ports S1, S2, S3, S4 each connected to a respective sense resistor RL of FIG. 2, drain ports D1, D2, D3 and D4, each connectable to a respective LED string 30 of FIG. 2, PWM ports PWM1, PWM2, PWM3 and PWM4, reference voltage port VREF, over-temperature port OVER_TEMP, drain voltage sensing port VD, power connection VCC, serial data in port DATA_IN, serial data out port DATA_OUT, clock port CLK and common potential connection GND. Each of PWM ports PWM1, PWM2, PWM3 and PWM4, reference voltage port VREF, over-temperature port OVER_TEMP, drain voltage sensing port VD, serial data in port DATA_IN and clock port CLK are arranged for connection to controller 110 of FIG. 2.

Dissipative active element array 100 comprises a plurality of dissipative active elements 105A, 105B, 105C and 105D, generally dissipative active element 105. Dissipative active element 105A comprises a field effect transistor (FET) M1 exhibiting a source, a drain and a gate, and a comparator A1 exhibiting a non-inverting input, an inverting input, an output and an enable input. The output of comparator A1 is connected to the gate of FET M1. The non-inverting input of comparator A1 is connected to reference voltage port VREF. The inverting input of comparator A1 is connected to source port S1. The source of FET M1 is connected to source port S1 and the drain of FET M1 is connected to drain port D1. PWM port PWM1 connects via a first input of an AND gate G5 to the enable input of comparator A1.

Dissipative active element 105B comprises a field effect transistor (FET) M2 exhibiting a source, a drain and a gate, and a comparator A2 exhibiting a non-inverting input, an inverting input, an output and an enable input. The output of comparator A2 is connected to the gate of FET M2. The non-inverting input of comparator A2 is connected to reference voltage port VREF. The inverting input of comparator A2 is connected to source port S2. The source of FET M2 is connected to source port S2 and the drain of FET M2 is connected to drain port D2. PWM port PWM2 connects via a first input of an AND gate G6 to the enable input of comparator A2.

Dissipative active element 105C comprises a field effect transistor (FET) M3 exhibiting a source, a drain and a gate, and a comparator A3 exhibiting a non-inverting input, an inverting input, an output and an enable input. The output of comparator A3 is connected to the gate of FET M3. The non-inverting input of comparator A3 is connected to reference voltage port VREF. The inverting input of comparator A3 is connected to source port S3. The source of FET M3 is connected to source port S3 and the drain of FET M3 is connected to drain port D3. PWM port PWM3 connects via a first input of an AND gate G7 to the enable input of comparator A3.

Dissipative active element 105D comprises a field effect transistor (FET) M4 exhibiting a source, a drain and a gate, and a comparator A4 exhibiting a non-inverting input, an inverting input, an output and an enable input. The output of comparator A4 is connected to the gate of FET M4. The non-inverting input of comparator A4 is connected to reference voltage port VREF. The inverting input of comparator A4 is connected to source port S4. The source of FET M4 is connected to source port S4 and the drain of FET M4 is connected to drain port D4. PWM port PWM4 connects via a first input of an AND gate G8 to the enable input of comparator A4.

Advantageously, an array of FETs, such as M1, M2, M3 and M4 are commercially available at very low cost. Thus, a multi-chip module comprising an array of FETs, and an additional integrated circuit containing the balance of the circuitry, as described in relation to dissipative active element array 100 may be produced at very low cost. Advantageously, a plurality of very low cost multi-chip modules of dissipative active element array 100 may be connected to a single controller 110, thereby reducing the cost of the overall architecture in which a single complex controller 110 is operative to control a number of low cost dissipative active element arrays 100, each thermally separate from controller 110.

In some embodiments, dissipative active element array further includes voltage samplers 75, 76, 77 and 78. Voltage sampler 75 comprises a D flip-flop 71 exhibiting a D port, a Q port and a Clock port, an AND gate G1 exhibiting two inputs and an output and an electronically controlled switch M5, illustrated as a FET, exhibiting a drain connected to D1, a source connected to drain voltage sensing port VD and a gate connected to the output of AND gate G1. Clock port CLK is fed into the Clock port of flip-flop 71. Serial data in port DATA_IN is connected to the D port of flip-flop 71. A first input of AND gate G1 is connected to PWM port PWM1. A second input of AND gate G1 is connected to the Q port of D flip-flop 71, which is denoted TC1.

Voltage sampler 76 comprises a D flip-flop 72 exhibiting a D port, a Q port and a Clock port, an AND gate G2 exhibiting two inputs and an output and an electronically controlled switch M6, illustrated as a FET, exhibiting a drain connected to D2, a source connected to drain voltage sensing port VD and a gate connected to the output of AND gate G2. Clock port CLK is fed into the Clock port of flip-flop 72. The D port of flip-flop 72 is connected to the Q port of flip-flop 71. A first input of AND gate G2 is connected to PWM port PWM2. A second input of AND gate G2 is connected to the Q port of D flip-flop 72, which is denoted TC2.

Voltage sampler 77 comprises a D flip-flop 73 exhibiting a D port, a Q port and a Clock port, an AND gate G3 exhibiting two inputs and an output and an electronically controlled switch M7, illustrated as a FET, exhibiting a drain connected to D3, a source connected to drain voltage sensing port VD and a gate connected to the output of AND gate G3. Clock port CLK is fed into the Clock port of flip-flop 73. The D port of flip-flop 73 is connected to the Q port of flip-flop 72. A first input of AND gate G3 is connected to PWM port PWM3. A second input of AND gate G3 is connected to the Q port of D flip-flop 73, which is denoted TC3.

Voltage sampler 78 comprises a D flip-flop 74 exhibiting a D port, a Q port and a Clock port, an AND gate G4 exhibiting two inputs and an output and an electronically controlled switch M8, illustrated as a FET, exhibiting a drain connected to D4, a source connected to drain voltage sensing port VD and a gate connected to the output of AND gate G4. Clock port CLK is fed into the Clock port of flip-flop 74. The D port of flip-flop 74 is connected to the Q port of flip-flop 73. A first input of AND gate G4 is connected to PWM port PWM4. A second input of AND gate G4 is connected to the Q port of D flip-flop 74, which is denoted TC4. The Q port of flip-flop 74 is connected to serial data out port DATA_OUT of dissipative active element array 100.

In some embodiments, dissipative active element array 100 comprises a plurality of temperature samplers 85, 86, 87 and 88. Temperature sampler 85 comprises a temperature protection module 91, a D flip-flop 81 exhibiting a D, Q, Qbar, Clock and S (Set) ports and an AND gate G9 exhibiting two inputs. One end of temperature protection module 91 is connected to common potential connection GND and a second end temperature protection module 91 is connected to the gate of FET M1 and the S port of flip-flop 81. The S port of flip-flop 81 is active low. The D port of D flip-flop 81 is connected to a common point, in one embodiment the common point being ground. The Q port of D flip-flop 81 is connected to the first input of AND gate G9. The Qbar port of D flip-flop 81 is connected to the second input of AND gate G5. A clock signal TC1, described above as the Q output of D flip-flop 71, is fed into the Clock port of flip-flop 81 and to the first input of AND gate G9. The Clock port of flip-flop 81 is responsive to the falling end of signal TC1. The output of AND gate G9 is fed into a first input of an OR gate G13.

Temperature sampler 86 comprises a temperature protection module 92, a D flip-flop 82 exhibiting a D, Q, Qbar, Clock and S (Set) ports and an AND gate G10 exhibiting two inputs. One end of temperature protection module 92 is connected to common potential connection GND and a second end of temperature protection module 92 is connected to the gate of FET M2 and the S port of flip-flop 82. The S port of flip-flop 82 is active low. The D port of D flip-flop 82 is connected to a common point, in one embodiment the common point being ground. The Q port of D flip-flop 82 is connected to the first input of AND gate G10. The Qbar port of D flip-flop 82 is connected to the second input of AND gate G6. A clock signal TC2, described above as the Q output of D flip-flop 72, is fed into the Clock port of flip-flop 82 and to the first input of AND gate G10. The Clock port of flip-flop 82 is responsive to the falling end of signal TC2. The output of AND gate G10 is fed into a second input of OR gate G13.

Temperature sampler 87 comprises a temperature protection module 93, a D flip-flop 83 exhibiting a D, Q, Qbar, Clock and S (Set) ports and an AND gate G11 exhibiting two inputs. One end of temperature protection module 93 is connected to common potential connection GND and a second end of temperature protection module 93 is connected to the gate of FET M3 and the S port of flip-flop 83. The S port of flip-flop 83 is active low. The D port of D flip-flop 83 is connected to a common point, in one embodiment the common point being ground. The Q port of D flip-flop 83 is connected to the first input of AND gate G11. The Qbar port of D flip-flop 83 is connected to the second input of AND gate G7. A clock signal TC3, described above as the Q output of D flip-flop 73, is fed into the Clock port of flip-flop 83 and to the first input of AND gate G11. The Clock port of flip-flop 83 is responsive to the falling end of signal TC3. The output of AND gate G11 is fed into a third input of OR gate G13.

Temperature sampler 88 comprises a temperature protection module 94, a D flip-flop 84 exhibiting a D, Q, Qbar, Clock and S (Set) ports and an AND gate G12 exhibiting two inputs. One end of temperature protection module 94 is connected to common potential connection GND and a second end of temperature protection module 94 is connected to the gate of FET M4 and the S port of flip-flop 84. The S port of flip-flop 84 is active low. The D port of D flip-flop 84 is connected to a common point, in one embodiment the common point being ground. The Q port of D flip-flop 84 is connected to the first input of AND gate G12. The Qbar port of D flip-flop 84 is connected to the second input of AND gate G8. A clock signal TC4, described above as the Q output of D flip-flop 74, is fed into the Clock port of flip-flop 84 and to the first input of AND gate G12. The Clock port of flip-flop 84 is responsive to the falling end of signal TC4. The output of AND gate G12 is fed into the fourth input of OR gate G13. The output of OR gate G13 is fed into the gate of a FET M9 exhibiting a grounded source, the above mentioned gate further coupled to the ground via resistor R5, and a drain connected to over temperature port OVER_TEMP port of controller 110.

In operation, each of dissipative active elements 105A, 105B, 105C and 105D is arranged to limit the current flow of the pulse width modulated current that flows through the associated LED string 30 connected to the respective drain port D1, D2, D3 and D4 to a value, responsive to a voltage value appearing at reference voltage port VREF set by controller 110 and delivered by data transfer interface 130. Specifically, the source of FETs M1-M4 exhibits the voltage representation of the current flowing through M1-M4 respectively which is also the current flowing through the LED string 30 associated with the particular dissipative active element 105A, 105B, 105C and 105D. Thus, comparators A1, A2, A3 and A4 are arranged to compare at any given time the voltage representation of the current flowing through FET M1-M4 to the voltage appearing at reference voltage port VREF from controller 110. AND gates G5-G8 whose outputs are connected to the respective enable input of comparators A1-A4 are arranged, in cooperation with PWM ports PWM1-PWM4 to alternately enable and disable current flow through dissipative active elements 105A-105D responsive to controller 110.

In some embodiments, voltage samplers 75-78 being operatively associated with a particular one of dissipative active elements 105A-105D respectively are arranged to sample a voltage associated with the LED string 30 associated with the particular dissipative active element 105A-105D respectively indicative of the voltage drop over the associated LED string 30. The voltage appearing at drain port D1 appears at drain voltage sensing port VD when the Q output of D flip-flop 71 is active and the signal at PWM port PWM1 is active. The voltage appearing at drain port D2 appears at drain voltage sensing port VD when the Q output of D flip-flop 72 is active and the signal at PWM port PWM2 is active. The voltage appearing at drain port D3 appears at drain voltage sensing port VD when the Q output of D flip-flop 73 is active and the signal at PWM port PWM3 is active. The voltage appearing at drain port D4 appears at drain voltage sensing port VD when the Q output of D flip-flop 74 is active and the signal at PWM port PWM4 is active.

The Q output of D flip-flops 71-74 are responsive to the data appearing at serial data in port DATA_IN. Thus, data transfer interface 130 is operative to clock in a serial data stream output by controller 110 exhibiting a number of bits equal to the sum of the number of drain ports (D1-D4) of the concatenated dissipative active element arrays 100, and exhibiting a single active bit representing the port to be read. The serial data appears at port DATA_IN and is clocked in to the various D flip flops 71-74 via a clock signal appearing at clock port CLK. The single active bit enables controller 110 of FIG. 2 to read the drain voltage of the respective drain port at voltage sensing port VD. Drain voltage sensing port VD thus provides an analog representation of the voltage appearing at the respective source of FETs M5-M8, reflecting the voltage drop across the respective LED string 30 connected at the respective drain port D1-D4.

According to some embodiments, voltage sensing module 116 is further operative, responsive to the voltage samples appearing at drain voltage sensing port VD, and in particular a marked change in voltage over time, to determine one of a short circuit and an open circuit in one of the constituent LEDs of a particular LED string 30, in a manner described in U.S. published patent application S/N 2007/0159750 published Jul. 12, 2007 to Peker et al, entitled "Fault Detection Mechanism for LED Backlighting", the entire contents of which is incorporated herein by reference.

According to some embodiments of the invention, voltage sensing module 116 is further operative, responsive to the voltage samples related to their corresponding dissipative active elements to identify an open circuit along an LED string.

According to some embodiments, temperature samplers 85-88 are arranged to disable current flow through the respective dissipative active elements 105A, 105B, 105C or 105D whenever an over temperature condition is sensed for the respective dissipative active element. Specifically, temperature protection modules 91-94 are arranged to sense an over temperature condition for FETs M1-M4 respectively, and in the event of an over temperature condition to ground the gates of FETs M1-M4. Flip-flops 81-84, are arranged in cooperation with AND gates G9-G12 and OR gate G13, to output an indication of an over temperature condition of at least one of FETs M1-M4 to controller 110 when the Q output of D flip flop 71, 72, 73 or 74, denoted signal TC1, TC2, TC3, TC4 respectively, is active. D flip flops 81, 82, 83 and 84 are each cleared by an active low output of the respective D flip flops 71, 72, 73 and 74, whose operation has been described above in relation to drain voltage sensing port VD. In the event that the over temperature condition persists, the respective temperature protection module 91, 92, 93 or 94 will not allow the reset of the respective D flip flop 81, 82, 83 or 84.

According to some embodiments, dissipative active element array 100 may be concatenated to another dissipative active element array 100. A plurality of dissipative active element arrays 100 may be packaged in a single multi-chip module, or in separate packaging without exceeding the scope. Concatenation may be achieved by connecting the serial data out port DATA_OUT of a first dissipative active element array 100 to the serial data in port DATA_IN of a subsequent concatenated dissipative active element array 100, and connecting the clock port CLK to a common clock output of controller 110. Optionally, the drain voltage sensing port VD and reference voltage ports VREF may be connected to common outputs of controller 110.

Figure 3B:
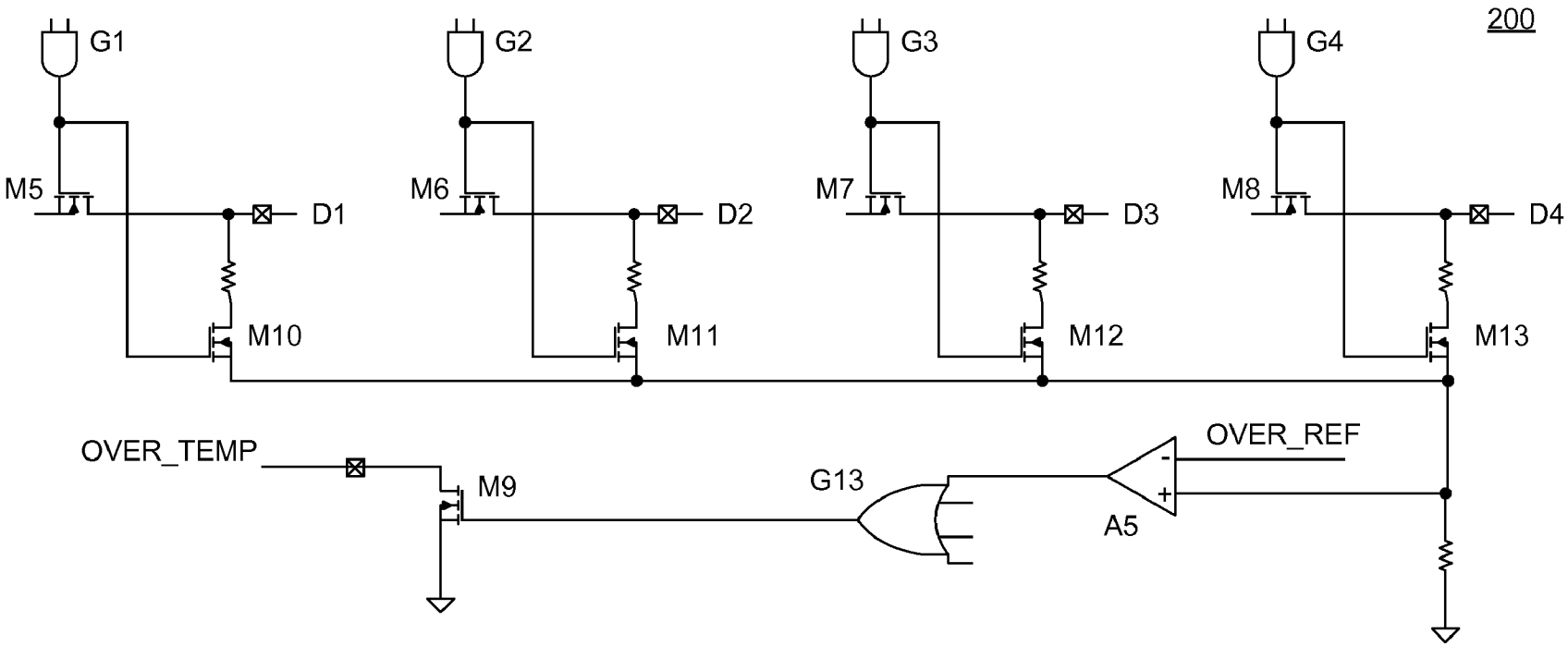
FIG. 3B is a circuit embodiment of an optional over voltage indication functionality according to some exemplary embodiments.

FIG. 3B is a circuit embodiment of an optional over-voltage indication functionality 200 according to some embodiments, arranged to be optionally provided within dissipative active element array 100 of FIG. 3A. For ease of understanding, certain elements from dissipative active element array 100 of FIG. 3A have been repeated in FIG. 3B. Over-voltage indication functionality 200 comprises a plurality of electronically controlled switches, M10-M13, illustrated as FETs, a comparator A5, a voltage reference source denoted OVER_REF, and a plurality of resistors. The drain of FET M10 is connected via a respective resistor to drain port D1, the drain of FET M11 is connected via a respective resistor to drain port D2, the drain of FET M12 is connected via a respective resistor to drain port D3, and the drain of FET M13 is connected via a respective resistor to drain port D4. The gate port of FET M10 is connected to the output of AND gate G1, the gate port of FET M11 is connected to the output of AND gate G2, the gate port of FET M12 is connected to the output of AND gate G3, and the gate port of FET M13 is connected to the output of AND gate G4. FETs M5-M8 are illustrated for clarity.

The sources of each of FETs M10-M13 are connected together to the non-inverting input of comparator A5, and via a respective resistor to a common voltage point, typically a ground point. The inverting input of comparator A5 is coupled to voltage reference source OVER_REF. The output of comparator A5 is fed as an additional input to OR gate G13, and the output of OR gate G13 is fed, as described above in relation to FIG. 3A, to the gate of FET M9.

In operation, each of FETs M10-M13 is active, i.e. allows current flow from drain to source, when the respective LED string 30 connected to the associated respective drain port D1, D2, D3, D4 is conducting current. Thus, FETs M10-M13 respectively function in a manner similar to that of FETs M5-M8, described above in relation to FIG. 3A. The respective voltage at drain port D1, D2, D3, D4 is then compared by comparator A5 to predetermined voltage reference source OVER_REF. Voltage reference source OVER_REF is selected such that only a short circuit of at least a predetermined number of LEDs, or a general short circuit, will enable the voltage at the respective drain port D1, D2, D3, D4 to exceed voltage reference source OVER_REF.

In the event that the voltage at any of drain ports D1, D2, D3, D4 exceeds voltage reference source OVER_REF, the output of comparator A5 is driven positive, which is passed by OR gate G13 to drive the gate of FET M9, thereby driving port OVER_TEMP towards ground. Controller 110 is operative to immediately detect the falling edge of port OVER_TEMP, and responsive thereto is operative to detect a fault condition, preferably determine the port at which the fault condition has occurred, and preferably operate to shut down the faulty port.

Figure 4:
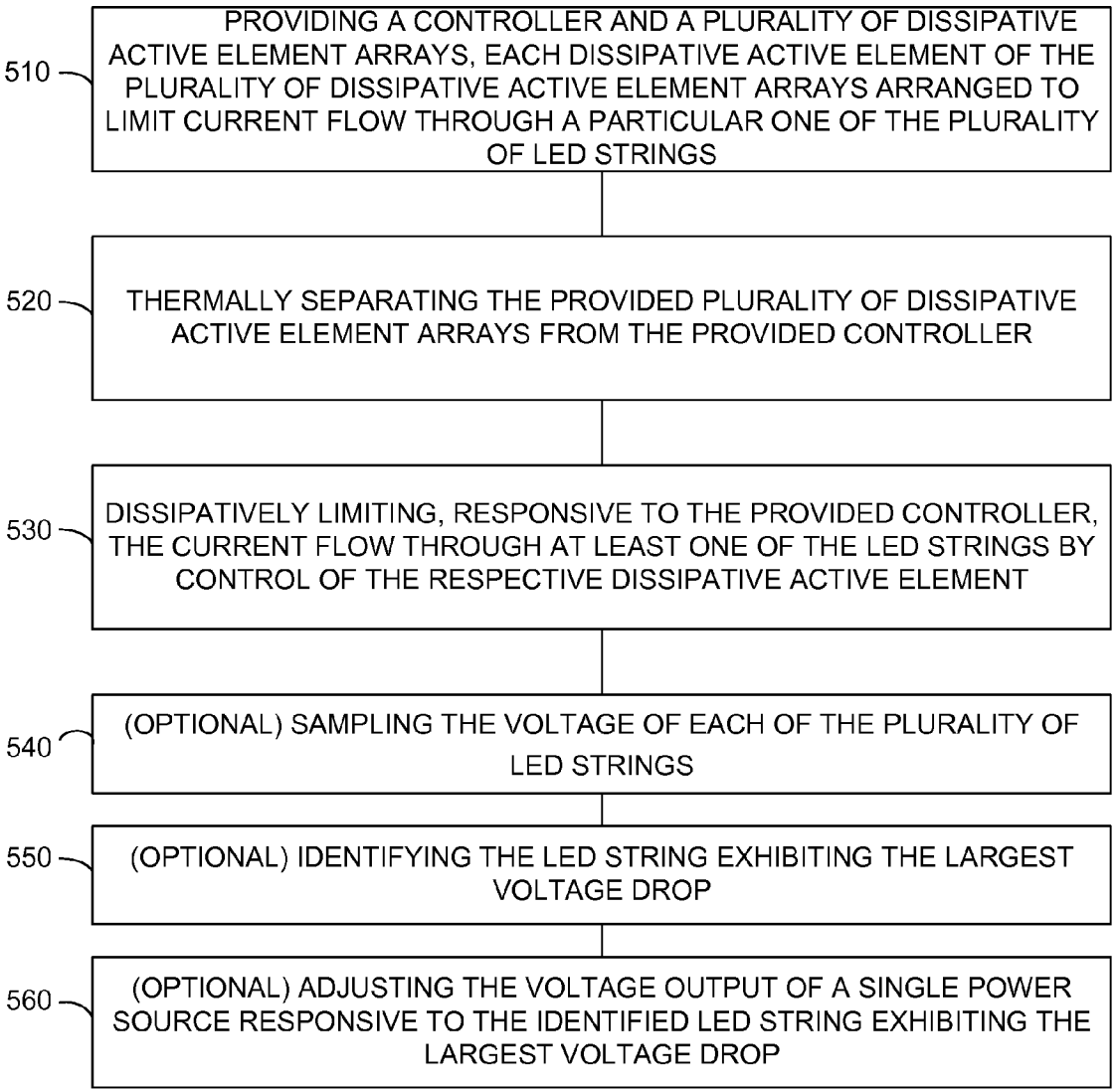
FIGS. 4-6 are high level flow charts of methods according to some exemplary embodiments to power and control a plurality of LED strings.

FIG. 4 is a high level flow chart of a method according to some embodiments to power and control a plurality of LED strings, comprising optionally sampling a voltage associated with at least one of the LED strings, and controlling a power source responsive thereto. In stage 510, a controller and a plurality of dissipative active element arrays are provided. Each dissipative active element of the plurality of dissipative active element arrays is arranged to limit current flow through a particular one of the plurality of LED strings. In stage 520 the plurality of dissipative active element arrays of stage 510 are thermally separated from the provided controller of stage 510. In stage 530, the current flow through at least one of the attached LED strings is dissipatively limited by a particular one of the dissipative active elements of stage 510, responsive to an output of the provided controller of stage 510.

In optional stage 540, a representative of the voltage drop across each of the LED strings is sampled. In one particular embodiment of stage 540, the voltage at the drain of the dissipative active element is sampled as a representative of the voltage drop across the respective LED string. In optional stage 550, the LED string exhibiting the greatest voltage drop is identified, and in optional stage 560 the voltage output of the power source is adjusted responsive to the sampled voltage of the identified LED string of stage 550.

The above has been described in an embodiment in which the power source is controlled responsive to the LED string exhibiting the largest voltage drop, however this is not meant to be limiting in any way. In another embodiment the power source is controlled responsive to a function of an electrical characteristic of at least one of the LED strings. Preferably the power source is controlled responsive to one of the lowest voltage drop, the mean voltage drop and the substantially average voltage drop from among the plurality of LED strings, in a manner described further in U.S. Patent Application Publication S/N 2007/0195025 A1, published Aug. 23, 2007 to Korcharz et al, entitled "Voltage Controlled Backlight Driver", incorporated above by reference.

Figure 5:
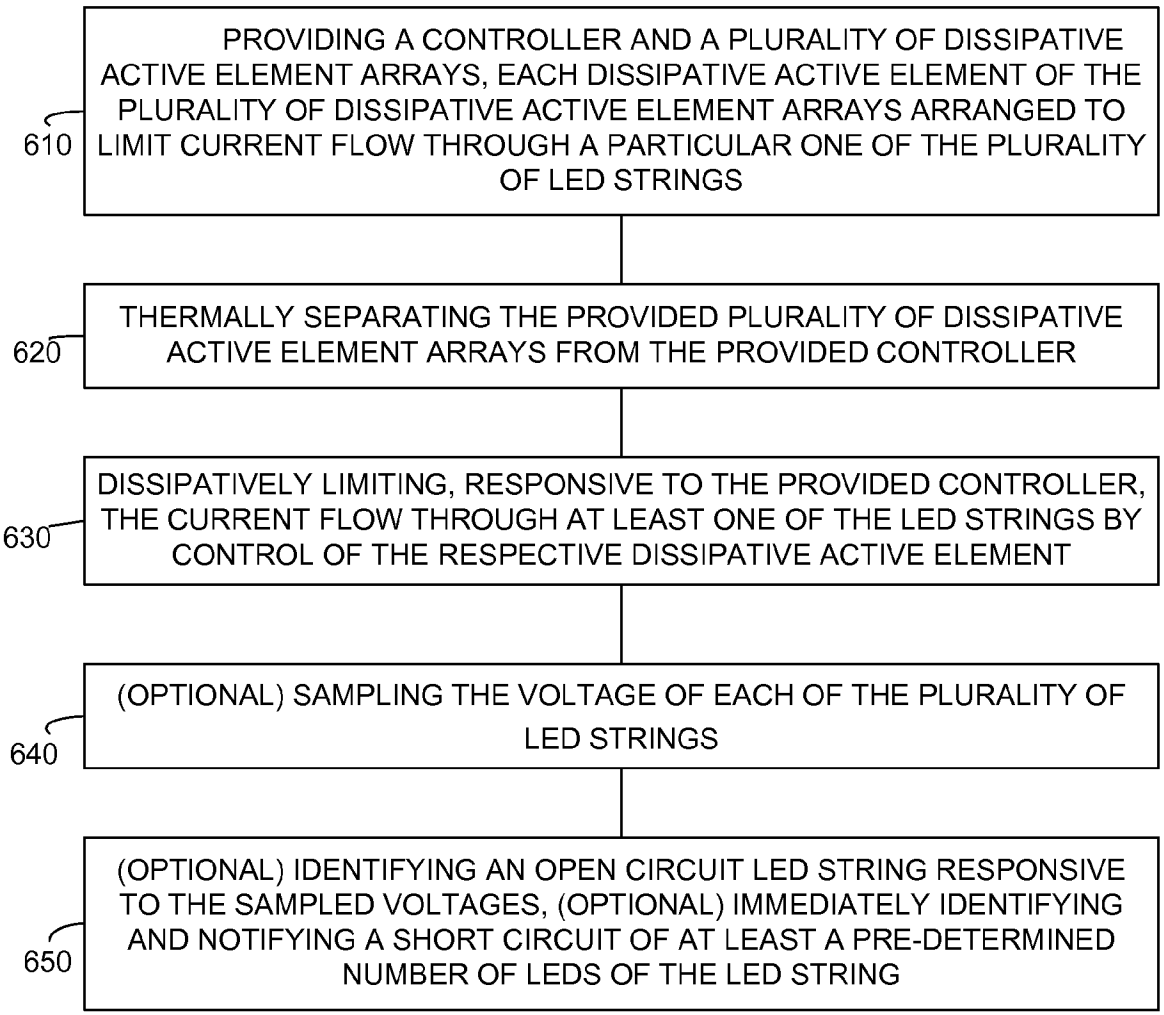

FIG. 5 is a high level flow chart of a method according to some embodiments to power and control a plurality of LED strings, comprising optionally sampling a voltage associated with at least one of the LED strings, and identifying an open circuit LED string responsive to the sampled voltages. In stage 610, a controller and a plurality of dissipative active element arrays are provided. Each dissipative active element of the plurality of dissipative active element arrays is arranged to limit current flow through a particular one of the plurality of LED strings. In stage 620 the plurality of dissipative active element arrays of stage 610 are thermally separated from the provided controller of stage 610. In stage 630, the current flow through at least one of the attached LED strings is dissipatively limited by a particular one of the dissipative active elements of stage 610, responsive to an output of the provided controller of stage 610.

In optional stage 640, a representative of the voltage drop across each of the LED strings is sampled. In one particular embodiment of stage 640, the voltage at the drain of the dissipative active element is sampled as a representative of the voltage drop across the respective LED string. In optional stage 650, an LED circuit exhibiting an open circuit condition is identified responsive to the optional sampled voltages of stage 640. In particular, responsive to a marked change in voltage over time, stage 650 is operative to determine a short circuit or an open circuit in one of the constituent LEDs of a particular LED string, in a manner described in U.S. published patent application S/N 2007/0159750 published Jul. 12, 2007 to Peker et al, entitled "Fault Detection Mechanism for LED Backlighting", incorporated above by reference. Further optionally in stage 650 the LED string is monitored to identify a short circuit of at least a predetermined number of constituent LEDs of the LED string. Upon identification of the short circuit, preferably by detecting a LED drain port voltage in excess of predetermined value, prompt notification is sent to the controller.

Figure 6:
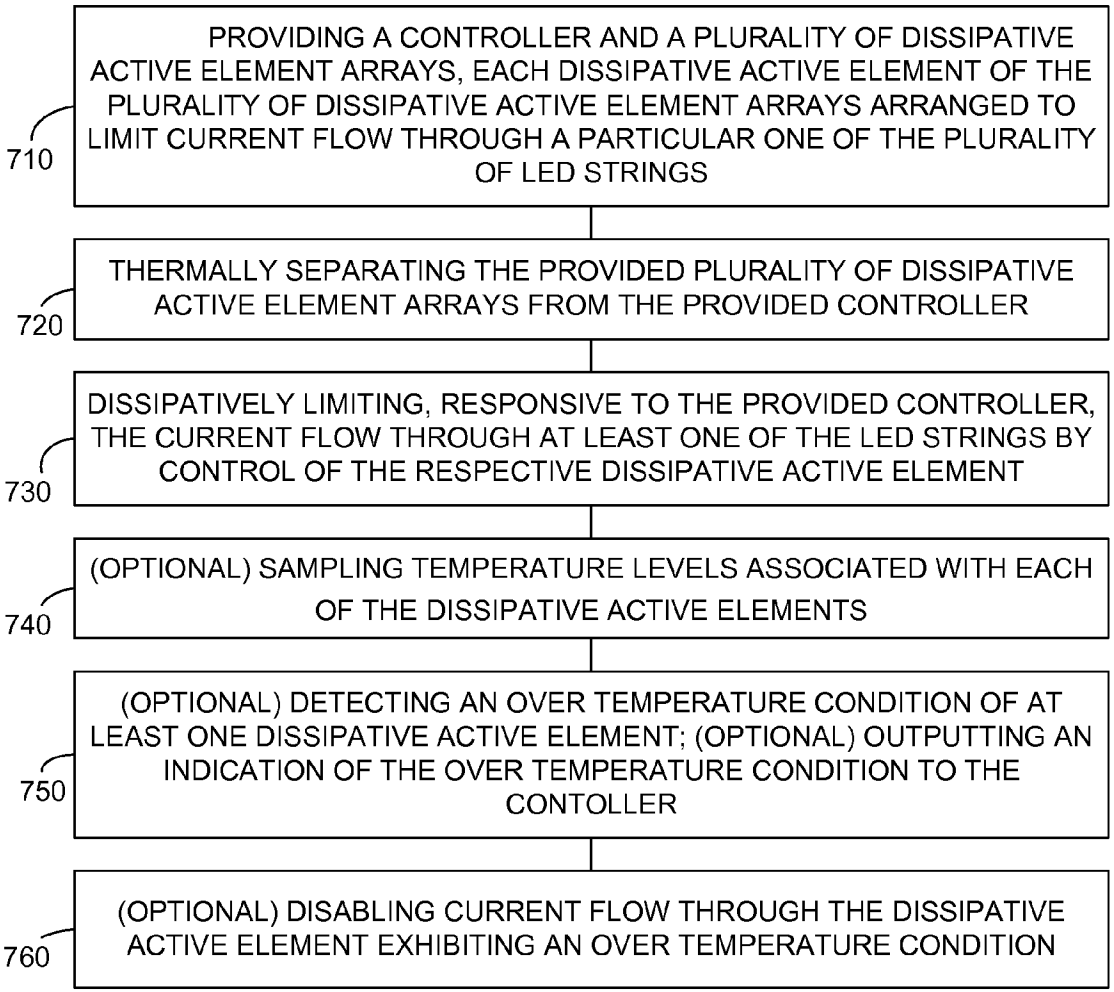

FIG. 6 is a high level flow chart of a method according to some embodiments to power and control a plurality of LED strings, comprising optionally sampling the temperature of the dissipative active elements, and disabling current flow through the dissipative active element responsive to an over temperature condition. In stage 710, a controller and a plurality of dissipative active element arrays are provided. Each dissipative active element of the plurality of dissipative active element arrays is arranged to limit current flow through a particular one of the plurality of LED strings. In stage 720 the plurality of dissipative active element arrays of stage 710 are thermally separated from the provided controller of stage 710. In stage 730, the current flow through at least one of the attached LED strings is dissipatively limited by a particular one of the dissipative active elements of stage 610, responsive to an output of the provided controller of stage 710.

In optional stage 740, a representative of the temperature level for each of the dissipative active elements of stage 710 are sampled. In optional stage 750, the temperature levels are each compared with a maximum temperature level to determine if an over temperature condition exists for any of the dissipative active elements of stage 710. Further optionally, in stage 750 an indication of the determined over temperature condition is output to the controller. In optional stage 760, current flow through the identified dissipative active element exhibiting an over temperature condition of stage 750 is disabled, thereby allowing for temperature recovery of the dissipative active element of stage 750 and preventing burn out.

Any publications, including patents, patent applications and articles, referenced or mentioned in this specification are herein incorporated in their entirety into the specification, to the same extent as if each individual publication was specifically and individually indicated to be incorporated herein. In addition, citation or identification of any reference in the description of some embodiments of the invention shall not be construed as an admission that such reference is available as prior art to the present invention.

While the invention has been described with respect to a limited number of embodiments, these should not be construed as limitations on the scope of the invention, but rather as exemplifications of some of the preferred embodiments. Those skilled in the art will envision other possible variations, modifications, and applications that are also within the scope of the invention. Accordingly, the scope of the invention should not be limited by what has thus far been described, but by the appended claims and their legal equivalents.

What is claimed is:

1. A chipset for powering and controlling a plurality of light emitting diode (LED) strings, the chipset comprising:

a controller integrated circuit comprising a pulse width modulating (PWM) functionality and a data transfer interface circuitry; and at least one dissipative active element array integrated circuit comprising a plurality of dissipative active elements, each of the dissipative active elements constituted of a respective field effect transistor, said at least one dissipative active element array integrated circuit packaged to be thermally separate from said controller integrated circuit, said at least one dissipative active element array integrated circuit arranged in a multi-chip module with said controller integrated circuit, wherein the PWM functionality is arranged to individually pulse width modulate a current flow through each of the LED strings, and wherein each of said plurality of dissipative active elements is associated with a particular one of the plurality of LED strings and is arranged to limit the current flow of the pulse width modulated current that flows through the particular LED string to a value, said value responsive to a value output by said controller integrated circuit via said data transfer interface circuitry.

2. A chipset according to claim 1, comprising a plurality of said dissipative active element array integrated circuits, wherein said controller integrated circuit is arranged to control each of said plurality of dissipative active element array integrated circuits.

3. A chipset according to claim 1, wherein said PWM functionality pulse width modulates said current flow by alternately enabling and disabling the respective one of said dissipative active elements.

4. A chipset according to claim 1, wherein each dissipative active element comprises a field effect transistor (FET) having a drain, a source and a gate, and a comparator, said comparator arranged to compare a voltage representation of the current flowing through said FET with a reference, said reference responsive to said controller integrated circuit, the output of said comparator being coupled to the gate of said FET.

5. A chipset according to claim 1, wherein each dissipative active element array integrated circuit further comprises:

a plurality of voltage samplers each operatively associated with a particular one of said dissipative active elements and arranged to sample a voltage associated with said particular dissipative active element indicative of the voltage drop over the associated LED string, each of said voltage samplers further arranged to output said sampled voltage to the data transfer interface circuitry of said controller integrated circuit.

6. A chipset according to claim 5, wherein the controller integrated circuit further comprises:

a voltage sensing module; and a power source control module in communication with said voltage sensing module, wherein the voltage sensing module is arranged to receive said output sampled voltage of each of the plurality of voltage samplers via the data transfer interface circuitry, and identify responsive to the sampled voltages the LED string exhibiting the largest voltage drop, and wherein the power source control module is arranged to control the voltage output of a power source arranged to power the plurality of LED strings responsive to said identified sampled voltage associated with the LED string exhibiting the largest voltage drop.

7. A chipset according to claim 6, wherein said voltage sensing module is further arranged, responsive to a change in sampled voltage associated with a particular LED string, to determine one of a short circuit and an open circuit in one of the constituent LEDs of said particular LED string.

8. A chipset according to claim 6, wherein said voltage sensing module is further arranged to identify an open circuit LED string.

9. A chipset according to claim 1, wherein said at least one dissipative active element array integrated circuit further comprises over temperature protection for each of said dissipative active elements of said dissipative active element array integrated circuit, said over temperature protection arranged to disable current flow through said dissipative active element exhibiting an over temperature condition.

10. A chipset according to claim 9, wherein said at least one dissipative active element array integrated circuit is further arranged to output an indication of said over temperature condition to said controller integrated circuit.

11. A chipset according to claim 1, wherein said at least one dissipative active element array integrated circuit further comprises an over-voltage indication functionality arranged to detect an over voltage condition associated with any of the plurality of LED strings and immediately pass said indication to said controller integrated circuit.

12. A chipset according to claim 1, wherein the PWM functionality is arranged to employ leading edge modulation.

13. A method of powering and controlling a plurality of LED strings using a single power source, the method comprising:

providing a controller integrated circuit and a plurality of dissipative active element array integrated circuits, each of said provided dissipative active element array integrated circuits comprising a plurality of dissipative active elements, each of the plurality of dissipative active elements arranged to limit current flow through a particular one of the plurality of LED strings;

thermally separating said provided plurality of dissipative active element array integrated circuits from said provided controller integrated circuit;

dissipatively limiting, responsive to said provided controller integrated circuit, the current flow through at least one of the LED strings by control of the respective dissipative active element;

sampling the voltage of each of the plurality of LED strings;

identifying the LED string exhibiting the largest voltage drop; and adjusting the voltage output of the single power source responsive to said identified LED string exhibiting the largest voltage drop.

14. The method according to claim 13, further comprising:

sampling the voltage of each of the plurality of LED strings; and identifying an open circuit LED string responsive to the sampled voltages.

15. The method according to claim 13, further comprising:

sampling temperature levels of each of said dissipative active elements;

detecting an over temperature condition of at least one dissipative active element; and disabling current flow through said dissipative active element exhibiting an over temperature condition.

16. The method according to claim 13, further comprising:

identifying, by one of said provided plurality of dissipative active element array integrated circuits, an over-voltage condition associated with any of the plurality of LED strings; and promptly transmitting said identified condition to said provided controller integrated circuit.

17. A lighting system comprising:

a controller integrated circuit comprising a pulse width modulating (PWM) functionality and a data transfer interface circuitry;

a plurality of dissipative active element array integrated circuits each comprising a plurality of dissipative active elements, said plurality of dissipative active element array integrated circuits packaged to be thermally separate from said controller, said plurality of dissipative active element array integrated circuits arranged in a multi-chip module with said controller integrated circuit, said controller integrated circuit arranged to control each of said plurality of dissipative active element array integrated circuits;

a controllable power source responsive to said controller integrated circuit; and a plurality of LED strings receiving power from said controllable power source, wherein the PWM functionality is arranged to individually pulse width modulate a current flow through each of the LED strings, wherein each of said plurality of dissipative active elements is associated with a particular one of the plurality of LED strings and is arranged to limit the current flow of the pulse width modulated current that flows through the particular LED string to a value, said value responsive to a value output by said controller integrated circuit via said data transfer interface circuitry.

18. A lighting system according to claim 17, wherein each dissipative active element array integrated circuit further comprises:

a plurality of voltage samplers each operatively associated with a particular one of said dissipative active elements and arranged to sample a voltage associated with said particular dissipative active element indicative of the voltage drop over the associated LED string, each of said voltage samplers further arranged to output said sampled voltage to the data transfer interface circuitry of said controller integrated circuit.

19. A lighting system according to claim 17, wherein each dissipative active element array integrated circuit further comprises:

an over-voltage indication functionality arranged to detect an over voltage condition associated with any of the plurality of LED strings and immediately pass said indication to said controller integrated circuit.

* * * * *